US008984823B2

(12) United States Patent
Wong

(10) Patent No.: US 8,984,823 B2
(45) Date of Patent: Mar. 24, 2015

(54) WALL CORNER STRIP

(75) Inventor: Kin Pong Wong, Hong Kong (CN)

(73) Assignee: OK Construction Materials (Supply) Company Limited, Hong Kong (CN)

( * ) Notice: Subject to any disclaimer, the term of this patent is extended or adjusted under 35 U.S.C. 154(b) by 0 days.

(21) Appl. No.: 13/140,019

(22) PCT Filed: Mar. 12, 2010

(86) PCT No.: PCT/CN2010/071013

§ 371 (c)(1),
(2), (4) Date: Jun. 16, 2011

(87) PCT Pub. No.: WO2010/081441

PCT Pub. Date: Jul. 22, 2010

(65) Prior Publication Data

US 2011/0258951 A1 Oct. 27, 2011

(30) Foreign Application Priority Data

Jan. 13, 2009 (CN) ..... 2009 2 0002327 U

(51) Int. Cl.
*E04B 1/00* (2006.01)

(52) U.S. Cl.
USPC ..... 52/255; 52/287.1

(58) Field of Classification Search
USPC ..... 52/85, 255, 287.1, 288.1, 256, 257, 272
See application file for complete search history.

(56) References Cited

U.S. PATENT DOCUMENTS

| | | | | | |
|---|---|---|---|---|---|
| 1,308,773 | A | * | 7/1919 | Clark | 52/255 |
| 2,904,856 | A | * | 9/1959 | Robinson | 52/255 |
| 5,699,638 | A | * | 12/1997 | Maylon | 52/86 |
| 5,778,617 | A | * | 7/1998 | Free | 52/255 |
| 5,816,002 | A | * | 10/1998 | Bifano et al. | 52/255 |
| 6,119,420 | A | * | 9/2000 | Koenig et al. | 52/255 |

FOREIGN PATENT DOCUMENTS

GB 2056523 A * 3/1981

* cited by examiner

*Primary Examiner* — Brian Glessner
*Assistant Examiner* — Adam Barlow

(57) ABSTRACT

A wall corner strip (1) comprises a longer board and a shorter board (18, 17) forming an inner angle (15). The lengths of two boards are unequal, and the inner angle (15) is less than 90°. A solid protruding edge (13) is provided at the inner angle (15), and two inflexed hooks (11) are provided on the second ends (182, 172) of the longer board and the shorter board (18, 17), respectively.

20 Claims, 1 Drawing Sheet

WALL CORNER STRIP

BACKGROUND OF THE PRESENT INVENTION

1. Field of Invention

The present invention relates to construction field, and more particularly to a wall corner strip adapted to make a right-angle wall corner.

2. Description of Related Arts

The traditional wall corners (mainly refer to indoor corners and the arris of the outer wall) of a building are needed to be right angle. During the construction process, workers make wall corners only by general tools and these right angles whether right or not mainly depends on the workers' skill and experiment. Therefore, the existing way to make right-angle corners is difficult to meet requirement. The wall corners obtained from the existing way are not formed by straight surfaces, are not good appearance, and are easy to damage by a careless collision. In addition, the existing way also has the disadvantages of wasting of labor, time and material.

Chinese Patent Application with a Publication Number. CN101126280A, titled "Corner-protective strip special for mud work" introduces a corner-protective strip which includes two corner-protective boards and an edge provided on the outer side of the butt joint of two corner-protective boards. But this strip has no inflexed hook and no reinforced ridge, so it does not have the function to be embedded into wall, and it is easy deformation, and lacks a structure combined with mortar. That is, this strip is easy to fall off, and does not have an effect on protecting corner. Therefore, it has no utility.

Another Chinese Patent Application with a Publication Number. CN2234475Y, titled "Datum strip for whitewashing" introduces a datum strip includes a corner board, an adjustable board, a plurality of reinforced ridges, and an arc supporting mandrel, wherein the corner board and the adjustable board are cross-connected with each other, and the arc supporting mandrel is positioned in an angle between the corner board and the adjustable board. This datum strip has reinforced ridges, but also does not have inflexed hook. So it is it does not have the function to be embedded into wall as well. In addition, during construction face bricks must cover on the external surface of the datum strip. So the datum strip is mainly used for a corner covered with face bricks, since it is especially used with face bricks for decoration. Due to its limitation, this datum strip can not be used for common wall bodies with large area, so it dose not have utility.

Another Chinese Patent Application with a Publication Number. CN2453071Y, titled "Wall molding strip" introduces a having a similar structure with above applications, so it is has the same problems.

In summary, the public techniques in this field have obvious deficiencies and they can not achieve desirable effects and meet the practical demands. Due to less utility of the public techniques, a novel technique is needed to satisfy the construction requirements.

SUMMARY OF THE PRESENT INVENTION

A main object of the present invention is to provide a wall corner strip which is made of a hard plastic material having excellent elasticity and anti-deformation capability (such as ABS). The wall corner strip has some special structures such as inflexed hooks and gradually increasing thickness, which make sure the wall corner strip dose not deform and drop, and help the wall corner strip to be firmly fixed on the wall corner and be combined with the wall corner into one body. That is, the wall corner strip of the present invention has met the requirement for making a right angle wall corner, at same time, it has overcome the defects existed in the Chinese Patent Applications with Publication Number. CN101126280A, Publication Number. CN2234475Y and Publication Number. CN2453071Y.

Accordingly, in order to accomplish the above objects, the present invention provides a wall corner strip which comprises a longer board with a longer width and a shorter board with a shorter width, wherein a first side of the longer board and a first side of the shorter board are connected together to form a right angle between the longer external surface of the longer board and the shorter external surface of the shorter board, and an inner angle between the longer internal surface of the longer board and the shorter internal surface of the shorter board. The wall corner strip further comprises a solid protruding edge extended outward from the connecting part of the first side of the longer board and the first side of the shorter board. The longer board has an inflexed hook extended inwardly from a second side of the longer board to form an inner inflexed angle, in the same way, the shorter board also has an inflexed hook extended inwardly from the second side of the shorter board to form an inner inflexed angle.

Preferably, both thicknesses of the longer board and the shorter board are increased gradually from the first sides of the longer board and the shorter board to the second sides of the longer board and the shorter board respectively so that the inner angle is less than 90° and the inner inflexed angles are larger than 90°

Preferably, the longer board and the shorter board further have at least one reinforced ridge extended outward from their external surfaces.

The longer board and the shorter board both have a plurality of through holes with various shapes provided therein.

The wall corner strip is made of hard plastic with excellent elasticity.

The protruding edge has a thickness of 2 mm and a width of 4 mm. Both the first sides of the longer board and the shorter board have a thickness of 1.2 mm, and both the second sides of the longer board and the shorter board have a thickness of 2 mm. The longer board has a width of 24 mm, and the shorter board has a width of 18 mm.

The benefits of the present invention are that the present invention is obviously different from the existing technologies in structure, function and performance. The wall corner strip has simple structure, anti-deformation capacity and good adhesion. To form a wall corner with the wall corner strip makes sure the wall corner is straight and strong. And the wall corner strip makes the construction procedure is material saving, labor saving, time saving, and not afraid of impact and collision.

Figure 1:
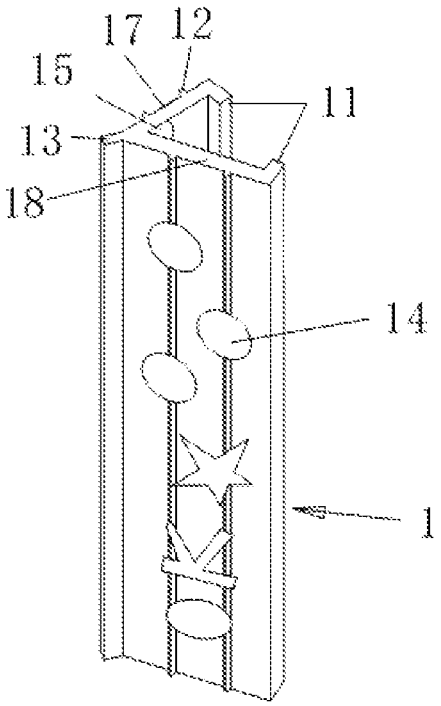
FIG. 1 is a schematic view of a wall corner strip according to a preferred embodiment of the present invention.

In the drawings, 1 wall corner strip, 11 inflexed hook, 12 reinforced ridge, 13 solid protruding edge, 14 through hole, 15 inner angle, 16 inner inflexed angle, 17 shorter board, 17*a* shorter internal surface 17*c* shorter external surface, 171 first end of the shorter board, 172 second end of the shorter board, 18 longer board, 18*b* longer internal surface, 18*c* longer external surface, 181 first end of the longer board, 182 second end of the longer board, 19 outer inflexed angle.

DETAILED DESCRIPTION OF THE PREFERRED EMBODIMENT

A further disclosure of the present invention will be described in the following with reference to the drawings.

Figure 2:
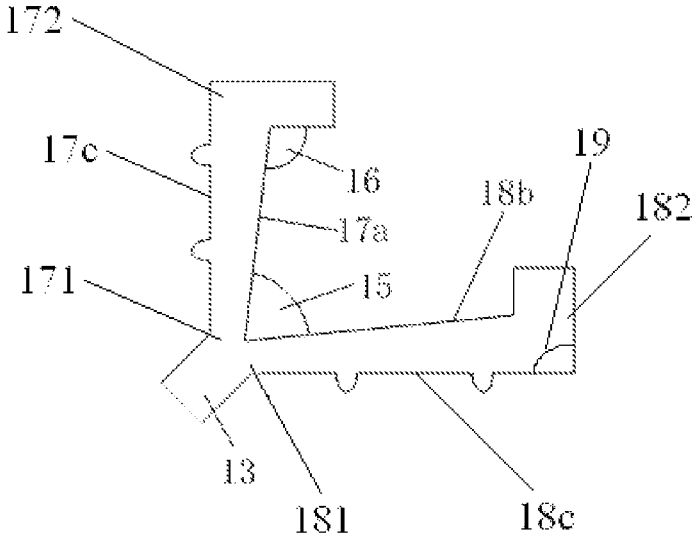
FIG. 2 is a top view of the FIG. 1.

Embodiment:

Referring to FIG. 1 and FIG. 2 of the drawings, a wall corner strip 1 adapted to form a right angle wall corner is illustrated. The wall corner strip 1 is an elongated body with a length of 2.5 to 3.5 m, wherein the length of the wall corner strip 1 is determined according to the length of the wall. The cross section of the wall corner strip 1 is two unequal sides.

The wall corner strip 1 comprises a longer board 18 with a longer width and a shorter board 17 with a shorter width, wherein a first end 181 of the longer board 18 and a first end 171 of the shorter board 17 are connected together to form a right angle between the longer external surface 18*c* of the longer board 18 and the shorter external surface 17*c* of the shorter board 17, and an inner angle 15 between the longer internal surface 18*b* of the longer board 18 and the shorter internal surface 17*a* of the shorter board 17.

The wall corner strip 1 further comprises a solid protruding edge 13 extended outwardly from the connecting part of the first end 181 of the longer board 18 and the first end 171 of the shorter board 17.

The longer board 18 has an inflexed hook 11 extended inwardly from a second end 182 of the longer board 18 to form an outer inflexed angle 19 of 90° between the longer external surface 18*c* and the inflexed hook 11, and an inner inflexed angle 16 between the longer internal surface 18*b* and the inflexed hook 11. In the same way, the shorter board 17 also has an inflexed hook 11 extended inwardly from the second end 172 of the shorter board 17 to form an outer inflexed angle 19 of 90° between the shorter external surface 17*c* and the inflexed hook 11, and an inner inflexed angle 16 between the shorter internal surface 17*a* and the inflexed hook 11.

According to the preferred embodiment of the present invention, the longer board 18 has a width of 24 mm, and the shorter board 17 has a width of 18 mm. Each inflexed hook 11 has a thickness of 1.2 mm and a width of 2 mm. The solid protruding edge 13 has a thickness of 2 mm and a width of 4 mm.

Preferably, both thicknesses of the longer board 18 and the shorter board 17 are increased gradually from the first ends 181 and 171 of the longer board 18 and the shorter board 17 to the second ends 182 and 172 of the longer board 18 and the shorter board 17 respectively. Therefore, the inner angle 15 is less than 90° and the inner inflexed angles 16 are larger than 90°, so as to enhance the tensile strength of the inflexed hooks 11, and make it not easy to deform. According to the preferred embodiment of the present invention, both the first ends of the longer board 18 and the shorter 17 have a thickness of 1.2 mm, and both the second ends of the longer board 18 and the shorter board 17 have a thickness of 2 mm.

Preferably, the longer board 18 further has at least one reinforced ridge 12 extended outwardly from the longer external surface 18*c* of the longer board 18. Similarly, the shorter board 17 further has at least one reinforced ridge 12 extended outwardly from the shorter external surface 17*c* of the shorter board 17. Furthermore, the longer board 18 has a plurality of through holes 14 with various shapes provided therein, and the shorter board 17 also has a plurality of through holes 14 with various shapes provided therein. These through holes 14 are adapted to help the wall corner strip 1 to fix with the cement and mortar.

Producing Method

The wall corner strip 1 is made of acrylonitrile butadiene styrene (ABS) resin or other hard plastic material having excellent elasticity. The method of producing the wall corner strip 1 comprising the step of integratedly forming the wall corner strip 1 by a prefabricate mold.

The longer board 18 and the shorter board 17 of the wall corner strip 1 have different widths. Due to such a structure as recited above, the external forces acted on the wall corner strip 1 would not be in a line, so that the tensile strength of the wall corner strip 1 is enhanced.

Using Method

A using method of the wall corner strip 1 comprising the steps of:

placing the wall corner strip 1 on a wall corner;

embedding the inflexed hooks 11 of the longer board 18 and the shorter board 17 into the bottom mortar of the wall corner, due to the gradually increasing thicknesses of the longer board 18 and the shorter board 17, the mortar filled in the wall corner strip 1 shapes an inverted triangle, so as to enhance the stability of the inflexed hooks 11, and then to fix the wall corner strip 1 on the wall corner firmly;

applying mortar to the wall corner strip 1, wherein the mortar enters into the through holes 14;

smoothing mortar on the wall corner strip 1 by a wooden board, then a right-angle wall corner is obtained.

Therefore, to form a wall corner with the wall corner strip 1 makes sure that the wall corner is straight, strong and good appearance.

Statement

Two test reports are provided herewith to illustrate novelty, nonobviousness and utility of the present invention, and the two test reports are both made on Feb. 23, 2010, by an agency authorized and designated by Hong Kong Government. See Appendix A and Appendix B.

The Appendix A titled "REPORT ON PULL OUT TEST OF PLASTIC ANGLE DEAD" shows that under an applied force of 1050 Newton, the sample of plastic angle bead (wall corner strip 1 in the present invention) has no visible damage.

The Appendix B titled "REPORT ON DETERMINATION OF SURFACE DAMAGE BY SMALL HARD BODY IMPACT" shows that under an impact energy of 10 Nm (the most level of the impact energy), that is, even through knocked by a heaviest hammer, there is only slight deformation of plastic edge (the longer board 18 and the shorter board 17 of the wall corner strip 1 in the present invention) being observed.

Therefore, the wall corner strip 1 of the present invention completely meets architectural requirements, and has obtained international certifications. It has been comprehensively applied in construction projects.

Comparing the present invention with the existing technologies, it is obviously to tell the differences therebetween, either in whole or in part. Furthermore, the two test reports certify that the present invention has brought unexpected results, and has prominent novelty, nonobviousness and utility.

What is claimed is:

1. A wall corner strip adapted to form a right angle wall corner, comprising:

a first board with a first width, having a first end, a second end, a first external surface, a first internal surface, and an inflexed hook extended inwardly from the second end of the first board to form an outer inflexed angle of 90° between the first external surface and the inflexed hook of the first board, and an inner inflexed angle between the first internal surface and the inflexed hook of the first board, a second board with a second width, having a first end, a second end, a second external surface, a second internal surface, and an inflexed hook extended inwardly from the second end of the second board to form an outer inflexed angle of 90° between the second external surface and the inflexed hook of the second board, and an inner inflexed angle between the second internal surface and the inflexed hook of the second board, wherein the first width of the first board is larger than the second width of the second board, the first end of the first board and the first end of the second board are connected together to form a right angle between the first external surface and the second external surface, and an inner angle between the first internal surface and the second internal surface, and a solid protruding edge extended outwardly from a connecting part of the first end of the first board and the first end of the second board, wherein both thickness of the first board and the second board are increased gradually from the first ends of the first board and the second board to the second ends of the first board and the second board respectively, so that the inner angle is less than 90° and the inner inflexed angles are larger than 90°.

2. The wall corner strip, as recited in claim 1, wherein the first board further has at least one reinforced ridge extended outwardly from the first external surface of the first board, and the second board further has at least one reinforced ridge extended outwardly from the second external surface of the second board.

3. The wall corner strip, as recited in claim 1, wherein the first board has a plurality of through holes with various shapes provided therein, and the second board has a plurality of through holes with various shapes provided therein.

4. The wall corner strip, as recited in claim 2, wherein the first board has a plurality of through holes with various shapes provided therein, and the second board has a plurality of through holes with various shapes provided therein.

5. The wall corner strip, as recited in claim 1, having a length of 2.5 to 3.5 m, wherein the length of the wall corner strip is determined according to the length of the wall.

6. The wall corner strip, as recited in claim 2, having a length of 2.5 to 3.5 m, wherein the length of the wall corner strip is determined according to the length of the wall.

7. The wall corner strip, as recited in claim 4, having a length of 2.5 to 3.5 m, wherein the length of the wall corner strip is determined according to the length of the wall.

8. The wall corner strip, as recited in claim 1, wherein both the first ends of the first board and the second board have a thickness of 1.2 mm, both the second ends of the first board and the second board have a thickness of 2 mm, and the first board has a width of 24 mm, the second board has a width of 18 mm.

9. The wall corner strip, as recited in claim 2, wherein both the first ends of the first board and the second board have a thickness of 1.2 mm, both the second ends of the first board and the second board have a thickness of 2 mm, and the first board has a width of 24 mm, the second board has a width of 18 mm.

10. The wall corner strip, as recited in claim 7, wherein both the first ends of the first board and the second board have a thickness of 1.2 mm, both the second ends of the first board and the second board have a thickness of 2 mm, and the first board has a width of 24 mm, the second board has a width of 18 mm.

11. The wall corner strip, as recited in claim 1, wherein each inflexed hook has a thickness of 1.2 mm and a width of 2 mm.

12. The wall corner strip, as recited in claim 2, wherein each inflexed hook has a thickness of 1.2 mm and a width of 2 mm.

13. The wall corner strip, as recited in claim 10, wherein each inflexed hook has a thickness of 1.2 mm and a width of 2 mm.

14. The wall corner strip, as recited in claim 1, wherein the solid protruding edge has a thickness of 2 mm and a width of 4 mm.

15. The wall corner strip, as recited in claim 2, wherein the solid protruding edge has a thickness of 2 mm and a width of 4 mm.

16. The wall corner strip, as recited in claim 13, wherein the solid protruding edge has a thickness of 2 mm and a width of 4 mm.

17. The wall corner strip, as recited in claim 1, wherein the wall corner strip is made of hard plastic material having elasticity.

18. The wall corner strip, as recited in claim 2, wherein the wall corner strip is made of hard plastic material having elasticity.

19. The wall corner strip, as recited in claim 3, wherein the wall corner strip is made of hard plastic material having elasticity.

20. The wall corner strip, as recited in claim 16, wherein the wall corner strip is made of hard plastic material having elasticity.

* * * * *